United States Patent [19]

Germeroth et al.

[11] Patent Number: 4,578,910

[45] Date of Patent: Apr. 1, 1986

[54] ELEVATED FLOOR PANEL SYSTEM

[75] Inventors: David J. Germeroth, Joppa; George F. Ray, III, Rockville, both of Md.

[73] Assignee: Donn Incorporated, Westlake, Ohio

[21] Appl. No.: 626,898

[22] Filed: Jul. 2, 1984

[51] Int. Cl.[4] ..... E04B 1/00

[52] U.S. Cl. ..... 52/105; 52/126.6; 52/263; 52/509; 52/584; 24/591; 403/332

[58] Field of Search ..... 52/126.6, 263, 509, 52/584, 105; 403/332, 303, 300, 402; 24/590, 591, 592, 593

[56] References Cited

U.S. PATENT DOCUMENTS

| | | | |
|---|---|---|---|
| 3,696,578 | 10/1972 | Swensen et al. | 52/792 |
| 3,943,674 | 3/1976 | Ray | 52/126.6 |
| 4,062,511 | 12/1977 | Ray | 52/584 X |
| 4,438,610 | 3/1984 | Fifer | 52/263 |

FOREIGN PATENT DOCUMENTS

| | | | |
|---|---|---|---|
| 1196345 | 7/1965 | Fed. Rep. of Germany | 52/126.6 |
| 2418319 | 10/1979 | France | 52/126.6 |

*Primary Examiner*—Alfred C. Perham
*Assistant Examiner*—Jean M. Lakemper
*Attorney, Agent, or Firm*—Pearne, Gordon, Sessions, McCoy, Granger & Tilberry

[57] ABSTRACT

A system for interlocking the edges and corners of adjacent panels of a pedestal supported, elevated floor construction. Edge and corner clamp units are put in place after set-up of the panels. The edge clamp units include a lower elongated element which drops through a similarly shaped gap between adjacent panels and is then rotated 90° out of alignment. A screw turned from the space above the floor draws the lower clamp element towards an upper clamp element to grip and interlock intervening edges of the adjacent panels. Adjacent corners of four panels are interlocked to a supporting pedestal by an overlying clamp plate. This corner clamp plate is releasably secured to the pedestal by an individual screw which is also tightened from the space above the floor.

16 Claims, 12 Drawing Figures

ELEVATED FLOOR PANEL SYSTEM

BACKGROUND OF THE INVENTION

The invention relates to improvements in multiple panel systems, and in particular to an anchoring system for stabilizing and interconnecting a rectangular array of individually removable panels.

PRIOR ART

Elevated floor structures are one form of a multiple panel system for which the present invention has application. It is conventional in such a system to construct a floor by arranging rectangular panels side-by-side into a rectangular array. Commonly, in floor systems, such panels are supported at their corners by regularly spaced pedestals, which in turn are supported on a subfloor. The space or plenum between the subfloor and panel floor is available for utility lines, air ducts, and the like. Ordinarily, panels are individually removable for servicing, modifying, augmenting, or otherwise working on such lines and ducts. U.S. Pat. No. 4,062,511 to Ray illustrates a bracket attachment which can be used to couple the edges of adjacent floor panels together. Ordinarily, this type of bracket is permanently attached to the panel, one on each side, and projects beyond the main profile of the panel to bridge a joint which its associated side forms with an adjacent panel. U.S. Pat. No. 3,943,674 to Ray illustrates several techniques for coupling adjacent panels. FIGS. 4 through 9 of this patent illustrate embodiments in which sides of adjacent panels are interconnected at their midlengths by a rotatable plug which is inserted therebetween. FIGS. 10 through 19 of this patent illustrate a tie connection between adjacent panels in which a screw is used to interconnect a projecting bracket and tabs.

SUMMARY OF THE INVENTION

The invention provides a securing system for multiple panel arrays, and is particularly suited for elevated floor installations. One aspect of the invention relates to "drop-in" panel clamp assembly means for coupling the midsections of adjacent panel edges together. As disclosed, a clamp assembly is received in a recessed area mutually provided by adjacent panel edges. The recess allows the clamp assembly to fit flush with the working floor surface while being exposed for assembly and disassembly operations. A single screw is incorporated in the clamp assembly for developing desired clamping forces on the panel edges.

In the preferred embodiment, the clamp assembly has a horizontally elongated, lower bar plate which is torsionally interlocked to a circular upper plate. The lower or bottom bar plate is adapted to pass through a similarly shaped, slightly oversized gap in the edges of adjacent panels of the recess. After axially, i.e., vertically, passing through the gap, the bottom bar plate is rotated 90 degrees out of registration with the gap by turning the top plate from above. Next, a machine screw which depends axially through the top plate and extends into the bottom bar plate is turned to draw the bottom plate element upwardly toward the top plate. Intervening edge portions of the panels are clamped between opposed top and bottom plate surfaces in a manner which tends to maintain adjacent panel areas in coplanar, fixed relation. The clamp assemblies are removable from the panels by reversing the described assembly steps.

Another aspect of the invention pertains to a panel corner clamp assembly. As disclosed, the panels include a recessed area at each of their corners. A single clamp plate is adapted to be received in the corner recesses of four adjacent panel covers flush with the upper working floor surface of the panels. A single machine screw passing axially through the corner clamp plate ties the panels to an associated pedestal. The panel corners are gripped between the clamping plate and a top plate of the pedestal, with clamping forces developed by the machine screw. Preferably, the top plate of the pedestal and panel corners provide interengaging projections and cavities to mechanically interlock these elements together in the horizontal plane of the floor.

The disclosed edge and corner clamp elements are releasable from above the floor to provide ready access to the plenum beneath the floor. The edge and corner clamp elements also serve to discourage unauthorized entry into the space above the floor from the plenum, since they are not releasable from the plenum space.

DESCRIPTION OF THE PREFERRED EMBODIMENT

Figure 1:
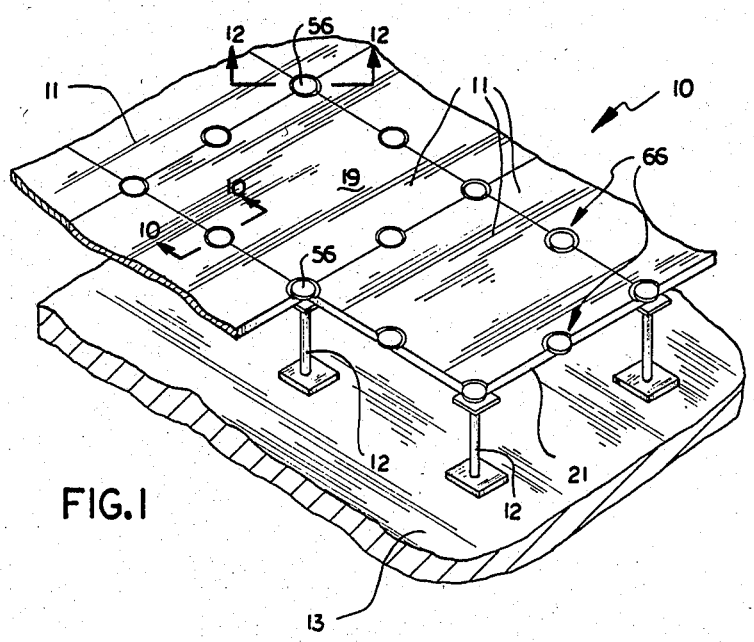
FIG. 1 is a schematic, fragmentary, perspective view of an elevated floor system embodying the invention.
Figure 2:
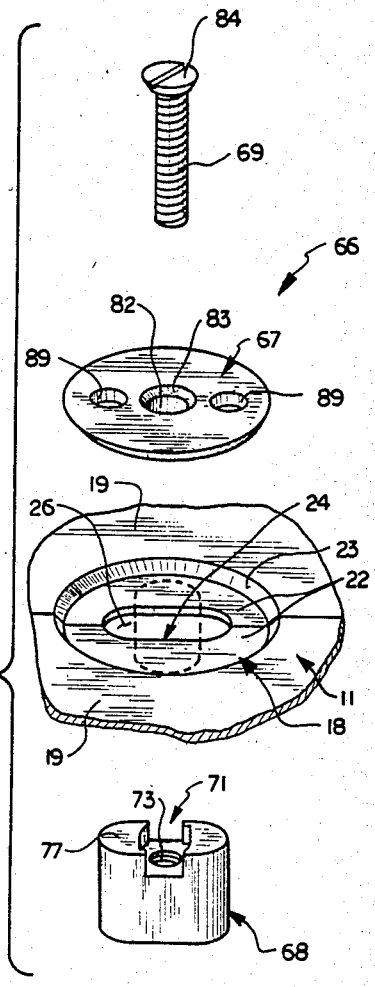
FIG. 2 is an exploded, perspective view of a panel edge clamp assembly embodying the invention.
Figure 3:
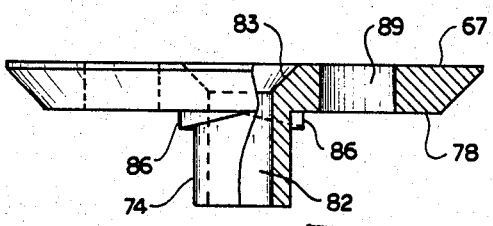
FIG. 3 is a side view, partially in section, of the top plate clamp element.

Referring now to the drawings, there is shown a multiple panel construction 10 in the form of an elevated floor system. The construction 10 includes a plurality of rectangular, ideally square, panels 11 arranged in a rectangular array. The panels 11 are supported at their corners by pedestals 12 standing on a sub-floor 13. The spacing of the pedestals 12 corresponds to the nominal side dimensions of the panels 11 so that away from the margins of the construction 10 each pedestal 12 supports the corners of four panels 11.

The illustrated panels 11 are constructed of a generally flat, upper steel plate 16 and a lower steel plate 17 which is embossed with peripheral and radial stiffening ribs, generally as shown, for example, in U.S. Pat. No. 3,696,578 to Swensen et al. The plates 16, 17 are substantially coextensive in the horizontal plane and are spot-welded or otherwise permanently secured together. The illustrated panels 11 each have semicircular formations 18 recessed below an upper working surface 19 of the top panel plate 16, adjacent each of their edges 21, and preferably midway between their respective corners. As illustrated, the recess 18 is formed by a semicircular depression in both plates 16, 17. An upper surface 22 of the top plate 16 in the recessed area is substantially planar and is spaced a predetermined vertical distance below the major upper or working face 19 of the top plate 16. The recessed portion of the top plate 16 includes a conical side wall 23 extending between the major working surface 19 and flat recessed surface 22. In centered relation to the semicircular recess 18 is an elongated notch 24 which is cut out of the panel plates 16,17 at their edges 21. The notches 24 of assembled adjacent panels 11 form an elongated gap or hole 26.

Figure 8:
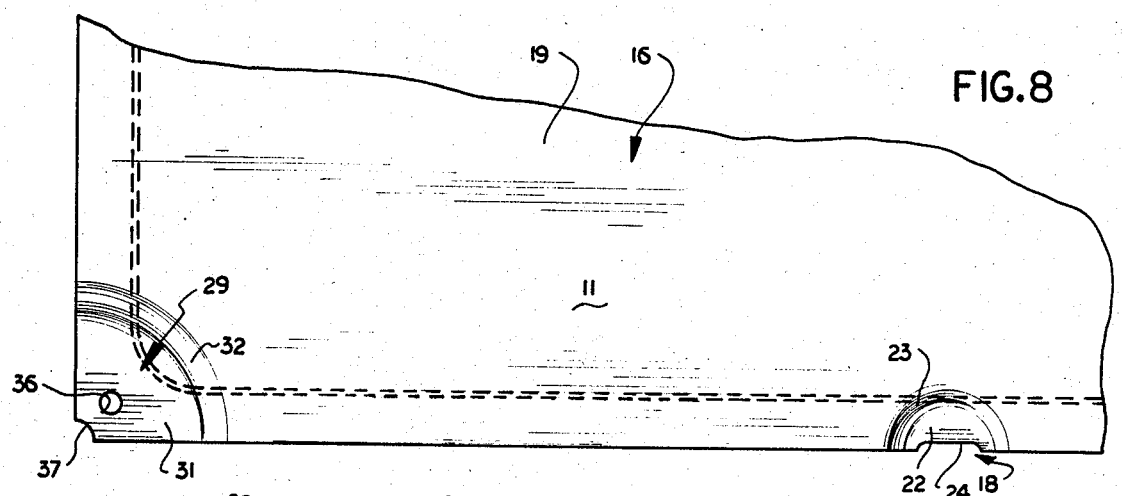
FIG. 8 is a fragmentary plan view of a corner and one edge of a panel.
Figure 9:
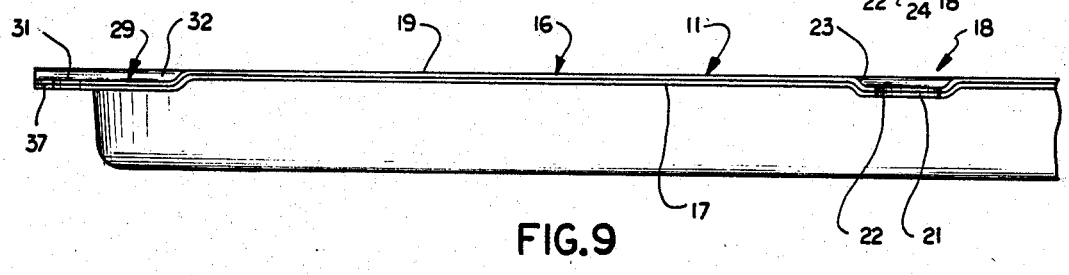
FIG. 9 is a fragmentary, elevational view of a corner and one edge of a panel.
Figure 11:
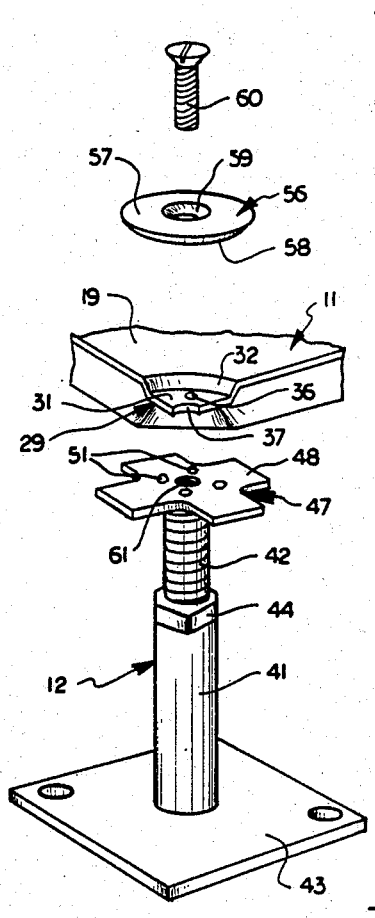
FIG. 11 is an exploded, perspective view of a panel corner clamp assembly.
Figure 12:
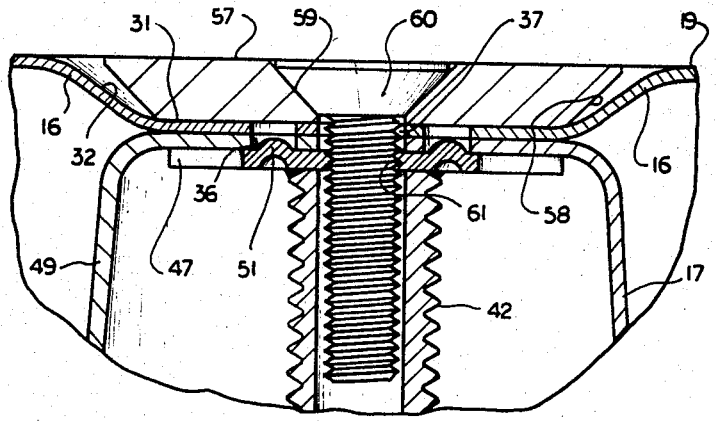
FIG. 12 is a fragmentary, cross-sectional view of the corner clamp assembly taken in the direction indicated by the line 12—12 of FIG. 1.

With particular reference to FIGS. 8, 9, and 11, the four corners of each panel 11 have a quadrantal recess 29 centered on the true or ideal corner of the panel. Like the earlier-described recesses 18, at the edge midlengths, the recesses 29 are formed by depressions in the upper plate 16. A bottom surface 31 of the quadrantal recess 29 is generally planar and spaced a predetermined distance below the panel working surface 19. This bottom recess surface 31 is surrounded by a conical side wall 32 formed in the upper plate 16. The lower plate 17 is formed to engage and conform to the underside of the recessed corner portion of the upper plate 16.

The upper and lower plates 16,17 are punched or otherwise formed with holes 36 in the recessed area. Each hole 36, ideally, is circular and is centered on an imaginary diagonal line extending between opposite corners of the panel 11 and is spaced inwardly from the true corner of the panel. The imaginary center of the recess 29 coincides with the imaginary or true corner of the panel 11. A quadrantal circular notch 37 formed in the panel plates 16,17 is also centered on the true corner of the panel 11.

The pedestals 12, in accordance with conventional practice, have telescoping tube portions 41, 42. The lower tube 41 is welded or otherwise fixed to a square base 43, which is fastened by adhesive or mechanical fasteners to the sub-floor 13. The upper tube 42, which is partially disposed in the lower tube 41, is formed with external threads engaged with a mating threaded nut 44 seated on an upper end of the lower tube 41. It will be understood that the height of the upper tube 42, and ultimately the portions of the panels 11 supported by the pedestal 12, can be adjusted by rotation of the nut 44. A rigid plate 47 is fixed by welding or other suitable means to the top end of the upper tube 42. In the illustrated case, the plate 47 is a cruciform having four identical arms 48 each adapted to fit between generally vertical surfaces 49 of peripheral ribs of the lower plate 17. Four circular projections 51, formed by stamping integral portions of the body of the plate 47 out of its plane, are equally spaced from the center of the plate and are on centerlines offset 45 degrees from the centerlines of the arms 48. The projections 51 are of equal outside diameter and height, and are sized to fit into the panel corner holes 36 without projecting beyond the plane of the recess surface 31.

The pedestals 12 are arranged in a rectangular array with a spacing corresponding to the side length dimensions of the panels 11. The panels 11 are assembled on the pedestals 12, with the corner holes 36 receiving the pedestal projections 51. The quadrantal recesses 29 of four panels 11 supported on a common pedestal 12 cooperate to form a circular pocket or recess centered above the pedestal. A generally flat, circular retaining or clamp plate 56 is dimensioned to fit in the pocket and releasably retain the panels 11 in position on the associated pedestal 12. The thickness of the clamp plate 56 is substantially equal to the spacing between the panel working surface 19, and the recessed surfaces 31.

An upper face 57 of the plate 56 is flush with the panel surfaces 19 when installed. The plate 56 has a conical peripheral surface 58 with a diameter sized to clear the surfaces of the recesses.

A central countersunk hole 59 is provided in the plate 56 for assembly of a flathead retaining screw 60 therethrough. The screw 60 is tightened into a mating threaded hole 61 provided in the center of the pedestal plate 47 to releasably hold the clamp plate 56 tightly against the underlying corner portions of the panels 11 and the corner portions, in turn, against the pedestal plate 47. The interengagement of the pedestal plate projections 51 and panel corner holes 36 prevents relative movement of the panels 11 and pedestal 12 in the horizontal plane.

With particular reference to FIGS. 2 through 7, an edge clamp assembly 66 is adapted to couple edges 21 of adjacent panels 11. The clamp assembly 66 comprises a top cover plate 67, a bottom bar plate 68, and a threaded machine screw 69 extending between these plate elements. The bottom or lower bar plate 68 is in the form of an elongated bar having a profile in plan view adapted to pass through the gap 26 formed by a pair of opposed notches 24 in adjacent panel edges 21 when in longitudinal alignment with this gap. As shown, this horizontal profile is an elongated figure having a length substantially greater than its width and having round ends. The vertical longitudinal profile of the bottom bar plate 68 is generally a simple rectangle interrupted by a slot 71 which cuts transversely through the upper midsection of the bar plate body. The slot or cavity 71 has its side walls in planes generally perpendicular to the plane of its upper face 72. The plan profile of the slot 71 is symmetrically arranged with respect to the axis of a central threaded hole 73 and is shaped closely to that of a projection 74 on the underside of the top plate 67 so that the latter can be inserted into and thereby torsionally interlocked or keyed to the former. Symmetry of the slot 71 and projection 74 allows their assembly in either of two 180-degree spaced orientations. The slot 71 has a major width measured in the lengthwise direction of the bar plate slightly larger than the width of the bar plate. Two opposite quadrants of the slot 71 are bounded by cylindrical surfaces 76 that have their axes coincident with the axis of the threaded hole 73. Vertical planar surfaces 75 of the slot 71 are stepped at 80 to bidirectionally interlock with corresponding areas 85 of the projection 74. The bar plate 68 is formed with a pair of coplanar, horizontal, upwardly facing clamping surfaces 77 on opposite sides of the slot 71. The threaded hole 73 is sized to mate with the threads of the screw 69.

The upper plate 67 is a generally circular disc having a lower face 78 on which the projection 74 is centrally arranged. The projection or hub 74 depends axially from the plate and is of substantially uniform cross section along its length. The profile of the projection 74 includes a pair of diametrally opposite cylindrical portions 79 concentric with the axis of the plate 67 and diametrally opposed right angles or planes 81 tangent to the cylindrical portions 79. The profile of the projection 74 is dimensioned to allow it to partially rotate in the panel recess gap 26.

An axial bore 82 through the plate 67 and projection 74 has a clearance diameter for the screw 69. The upper end of the bore 82 is counterbored with a conical seat 83 for flush reception of a flat head 84 of the screw 69.

Figure 4:
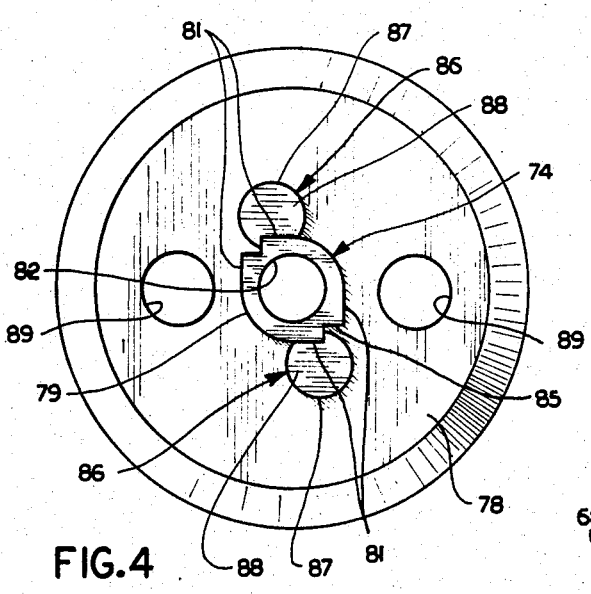
FIG. 4 is a bottom view of the top plate clamp element of FIG. 3.
Figure 5:
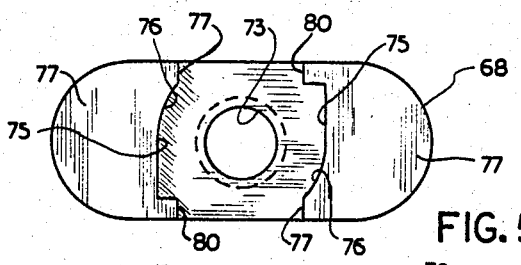
FIG. 5 is a top view of a bottom bar plate clamp element.
Figure 6:
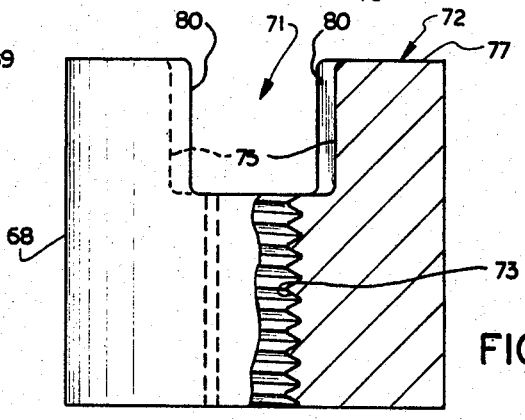
FIG. 6 is a side view, partially in section, of the bottom bar plate clamp element of FIG. 5.

A pair of depending circular tabs or projections 86 are disposed on diametrally opposite sides of the main projection 74. The major diametral distance between distal portions 87 of the tabs 86 is less than the length of the gap 26. Similarly, the diameter of the tabs is less than the width of the gap 26. Lower faces 88 of the tabs 86, as shown in FIG. 4, are inclined by an angle of 14 degrees, for example, with respect to the horizontal plane of the plate 67. These surfaces are inclined in opposite relative directions when viewed in FIG. 3, in an orientation analogous to a right-hand screw with reference to the axis of the plate 67. A pair of diametrally opposite holes 89 extend through the plate 67 and provide, by their internal surfaces, means for gripping and extracting the plate from the panel recess 18. The position of these holes 89, moreover, affords a visual indication of the angular position of the top plate 67.

The top and bottom plates 67, 68 are assembled together by axially inserting the top plate projection 74 into the bottom bar plate cavity or slot 71. The disclosed geometry of the projection 74 and slot 71 requires that the elements be angularly oriented in either of two positions 180 degrees apart from one another. Because of their mating acircular profiles, when interengaged, the disc projection 74 and slot 71 are torsionally keyed against relative angular rotation.

When properly oriented, the projection 74 slips into the slot 71 and an imaginary line between the disc holes 89 is angularly aligned with the lengthwise direction of the bottom bar plate 68. The top and bottom plates 67, 68 are releasably held in interlocked, preassembled relation by the screw 69, which is inserted into the counterbored end of the axial bore 82 and into the threaded bore 73 of the bottom bar plate. The length of the screw 69 is sufficient to engage several threads in the bottom bar plate, while leaving a measureable gap between the upper surfaces 77 of the bottom bar plate 68 and the lower face 78 of the top plate 67. As will be understood from the discussion below, this preassembled gap is at least as large as the height of the tabs 86 combined with the total thickness of the two panel plates 16, 17 in the area of the recesses 18. The top and bottom clamp plate assembly 66 is initially positioned by aligning the bottom bar plate over and allowing it to drop through the gap 26 to an elevation below the lower panel plate 17 in the area of the recess 18. The top plate 67 is then manually or otherwise rotated clockwise, looking down, through an angle of 90 degrees.

Figure 7:
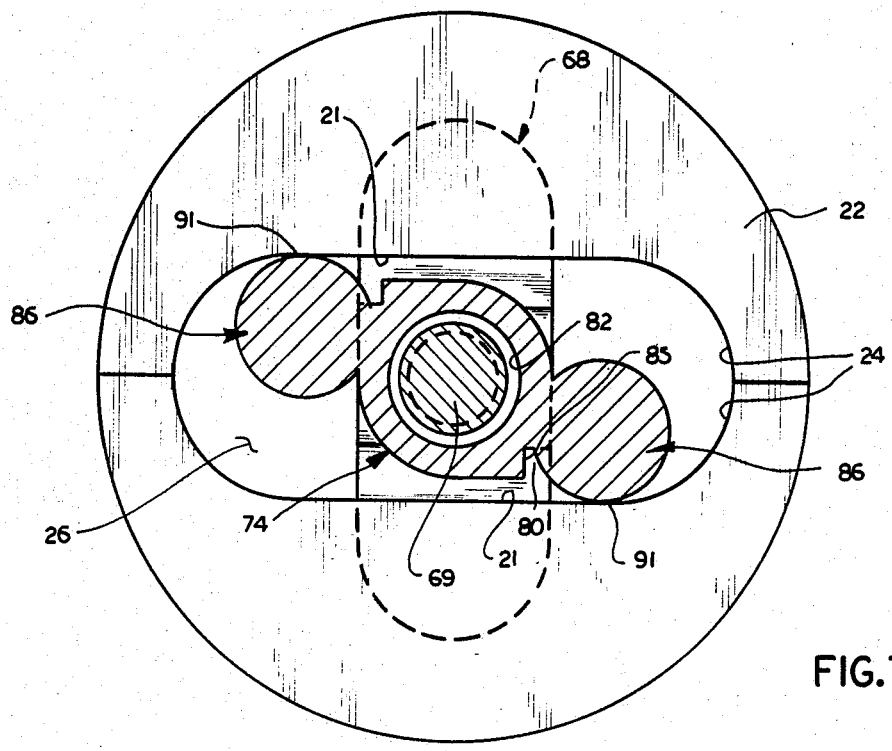
FIG. 7 is a cross-sectional view, taken in a horizontal plane of the clamp assembly in an installed condition.

The tabs 86, initially with the bottom bar plate 68 aligned with the gap 26, rest on the recess bottom surface 22. Upon 90-degree rotation of the top plate 67, the tabs 86 move into the gap 26, allowing the top plate 67 to become flush with the upper working surface 19 and cause their vertical surfaces, designated 91, to engage or index with the vertical edges 21 of the notches 24, thereby preventing further clockwise rotation (FIG. 7). At this stage, the bottom bar plate 68, being torsionally coupled to the top plate 67, has turned 90 degrees out of alignment with the gap 26. Subsequently, the screw 69 is turned clockwise to draw the bottom bar plate surface 77 into engagement with the lower panel plate 17 at the area of the recess 18. A sufficient torque is applied to the screw 69 to ensure that the clamping force between the top and bottom plates 67, 68 is adequate to hold the associated panels 11 in place.

Figure 10:
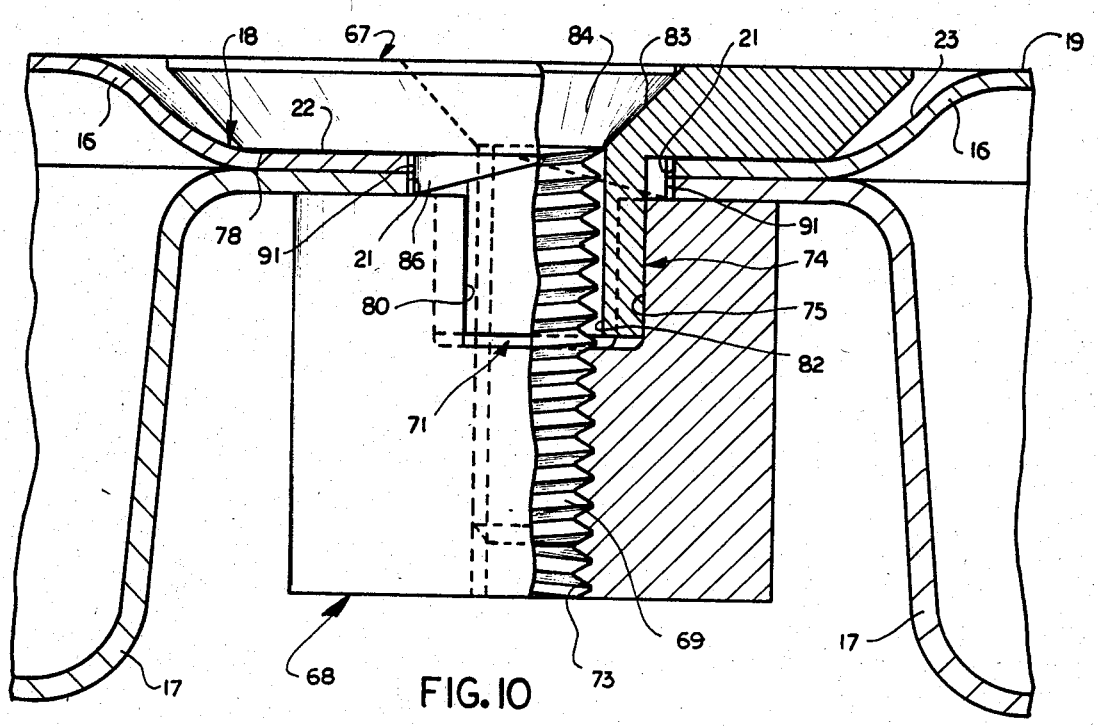
FIG. 10 is a cross-sectional view, taken in a vertical plane indicated by the line 10—10 of FIG. 1, of the clamp assembly in an installed condition of a pair of adjacent panels.

FIG. 10 illustrates the clamp assembly 66 in its operative position. It will be understood that top and bottom plate clamp assemblies can be released simply by turning the screw 69 counterclockwise. The assembly 66 can thereafter be removed by rotating the top and bottom plates 67, 68 counterclockwise through 90 degrees to again align the bottom bar plate with the gap 26. The assembly 66 is then lifted, for example, by gripping the holes 89 with a suitable pliers. The tabs 86 do not obstruct counterclockwise rotation of the top plate 67 because their inclined surfaces 88, which lead in this direction, cam up the edges 21 of the notches 24.

The top and bottom plates of the assembly 66 are fabricated of suitable structural material, such as by powder metallurgy techniques, die casting, or other known processes. The disclosed clamp assembly 66 does not require special bracketry or like provisions on the panels 11 other than the disclosed recesses 18 or their equivalents, and avoids the necessity of protrusions extending beyond the square or rectangular profile of the panels. The clamp assembly 66 utilizes only a single screw to interlock adjacent panels with its clamping action. The edge clamp assembly 66 is conveniently installed after the floor panels 11 are set in place, and is readily released from above the floor system. The corner clamp plates 56 combine with the panel edge clamp assembly 66 to form a rigid floor structure capable of supporting static and dynamic loading on the panels. Moreover, the corner and edge clamp assemblies provide a high degree of security by preventing unauthorized access into a room from the plenum beneath the elevated floor, since the associated screws holding the clamp elements together cannot be readily released from below.

Although the preferred embodiment of this invention has been shown and described, it should be understood that various modifications and rearrangements of the parts may be resorted to without departing from the scope of the invention as disclosed and claimed herein.

What is claimed is:

1. An elevated floor system comprising a plurality of substantially identical rectangular panels supported at their corners in adjacency in a regular rectangular array, edge coupling means on adjacent pairs of edges of said panels intermediate their corners, said edge coupling means including upper and lower clamp elements, adjacent pairs of panel edges providing a gap therebetween, the gap having a width transverse to the associated adjacent edges of the panels and a length parallel to such edges, said lower clamp element in plan view having a width less than the width of said gap and a length greater than said gap width but sufficiently limited to permit said lower clamp element to be dropped through said gap when said lower element is longitudinally aligned with said gap, said lower clamp element being suspended from said upper clamp element and carried on the respective adjacent panels and being rotatable through said gap to a position out of alignment with said gap, and releasable tightening means to draw said lower clamp element towards said upper element and thereby grip intervening edge areas of said respective panels.

2. A floor system as set forth in claim 1, wherein said panels include recesses at their upper surface, said upper clamp elements being received in said recesses and having a height substantially equal to the depth of said recesses whereby said upper clamp elements are flush with the upper working surface of said panels.

3. An elevated floor system as set forth in claim 1, wherein said tightening means comprises a machine screw having its head carried on said upper clamp element, said machine screw being threaded into said lower clamp element.

4. An elevated floor system as set forth in claim 1, including means for torsionally coupling said upper and lower clamp elements together whereby said lower clamp element can be rotated by rotating said upper clamp element from the space above said elevated floor system.

5. An elevated floor system as set forth in claim 4, wherein said recess and upper clamp element are circular in plan view.

6. An elevated floor system as set forth in claim 5, wherein said upper clamp element includes visual indicator means for indicating the orientation of said lower clamp element.

7. An elevated floor system as set forth in claim 4, wherein said torsion coupling means comprises interengaging portions integrally formed on each of said lower and upper clamp elements.

8. An elevated floor system as set forth in claim 1, including indexing means adapted to cooperate with said gap to limit rotation of said lower clamp element to substantially 90° from the position at which it is aligned with said gap for passage therethrough.

9. An elevated floor system as set forth in claim 8, wherein said upper and lower clamp elements are rotationally coupled together, said indexing means being disposed on the lower side of said upper clamp element.

10. An elevated floor system as set forth in claim 9, wherein said indexing means includes a first surface means engageable with edges of said panels adjacent said gap to limit rotation of said clamp elements to a position 90° from the longitudinally aligned position of said lower clamp element.

11. An elevated floor system as set forth in claim 10, wherein said indexing means includes camming surface means facilitating reverse rotation of said clamp elements from the 90° rotated position.

12. A drop-in clamp for interconnecting elevated floor panels comprising upper and lower clamp elements, the lower clamp element having an elongated profile in plan view with a pair of upwardly facing surfaces on opposite sides of its center, the upper clamp element having a profile in plan view of greater width than said lower clamp element, said upper and lower clamp elements being interengaged through respective portions of common elevation in a manner which torsionally couples such elements while allowing a limited vertical movement therebetween, screw threaded tightening means extending vertically with its axis through said center of the lower clamp element, said upper clamp element having a lower face adapted to engage portions of a pair of adjacent floor panels and being supported thereby, said upper clamp element including indexing means registerable with an area of said pair of adjacent floor panels to position said lower clamp element such that its length is transverse to the joint between said adjacent pair of panels, said tightening means being operative when rotated to draw said clamp elements together such that their surfaces grip intervening surface areas of said panels, said clamp elements, when gripping said intervening panel areas, being effective to resist deflection of one panel relative to the other and distribute loads on one panel to the other.

13. A panel clamp as set forth in claim 12, wherein said lower clamp element has a configuration adapted to pass through a gap between said pair of panels of predetermined size, said indexing means having a configuration adapted to register with said gap.

14. A clamp as set forth in claim 13, wherein said indexing means includes means to resist rotation of said upper clamp element in one direction after it has registered with said gap.

15. A drop-in clamp assembly for tying the edges of adjacent panels in an elevated floor system comprising upper and lower clamp elements, the lower clamp element having an elongated profile in plan view, the lower clamp element profile being generally symmetrical with respect to a vertical axis passing through its centroid, said lower clamp element having a vertical internally threaded hole centered on its axis, said lower clamp element having an upper face defined in part by said profile, said lower clamp element having a cavity open at its upper face adjacent said axis and being noncircular with respect to said axis, said upper clamp element having a circular profile in plan view with an outer diameter substantially greater than the minimum width of the plan profile of the lower clamp element, the upper clamp element having a central vertical hole, said upper clamp element having a centrally disposed depending hub, a portion of said hub being disposed in said cavity, the configuration of the hub portion received in said cavity being arranged to interengage with surrounding areas of said lower clamp element to torsionally couple said elements together whereby said lower clamp element can be positively rotated by rotation of said upper clamp element, and a threaded fastener assembled in said central hole from an upper face of said upper clamp element and being in threaded engagement with the internally threaded hole of said lower clamp element, said threaded element when rotated in said lower clamp element causing said lower clamp element to be drawn toward said upper clamp element.

16. An elevated floor system comprising a plurality of substantially identical rectangular panels supported in adjacency in a rectangular array at their corners by a plurality of pedestals, each pedestal supporting the adjacent corners of four panels, a corner clamp plate disposed above each pedestal, a portion of each of said adjacent panel corners being gripped between the overlying corner clamp plate and the underlying pedestal, corner plate tightening screw means extending between each corner clamp plate and underlying pedestal, said screw means being manipulatable from above said floor system for its rotation, rotation of said screw means developing a releasable clamping force in said clamp plate on said panel cover portions against said pedestal, edge clamp means on adjacent pairs of edges of said panels intermediate their corners, said edge clamp means including upper and lower clamp elements, adjacent pairs of panel edges providing a gap therebetween, said lower clamp element in plan view having a width less than the width of said gap and a length less than the length of said gap whereby said lower clamp element may be dropped through said gap when said lower element is longitudinally aligned with said gap, said lower clamp element being suspended from said upper clamp element and carried on the respective adjacent panels and being rotatable through said gap to a position out of alignment with said gap, edge clamp screw means extending between said upper clamp element and said lower clamp element, said edge clamp screw means being manipulatable from above said floor system for its rotation, rotation of said edge clamp screw means developing a releasable clamping force between said upper and lower clamp elements on said panel edges, said corner clamp plate and edge clamp means interlocking said panels together and discouraging unauthorized access to the space above said floor system from below.

* * * * *